US005245967A

United States Patent [19]

Reuter

[11] Patent Number: 5,245,967

[45] Date of Patent: Sep. 21, 1993

[54] DEVICE FOR ACTUATING A LOAD ADJUSTING ELEMENT OF A FUEL SUPPLY DEVICE FOR INTERNAL COMBUSTION ENGINES

[75] Inventor: Uwe Reuter, Ditzingen, Fed. Rep. of Germany

[73] Assignee: Robert Bosch GmbH, Stuttgart, Fed. Rep. of Germany

[21] Appl. No.: 856,040

[22] PCT Filed: Feb. 4, 1991

[86] PCT No.: PCT/DE91/00094

§ 371 Date: May 6, 1992

§ 102(e) Date: May 6, 1992

[87] PCT Pub. No.: WO91/13250

PCT Pub. Date: Sep. 5, 1991

[30] Foreign Application Priority Data

Feb. 23, 1990 [DE] Fed. Rep. of Germany ..... 4005689

[51] Int. Cl.[5] ..... F02B 77/00; F02D 41/00

[52] U.S. Cl. ..... 123/359; 123/198 D

[58] Field of Search ..... 123/357, 358, 359, 479, 123/385, 386, 387, 388, 198 D, 396, 399, 401

[56] References Cited

U.S. PATENT DOCUMENTS

| | | | |
|---|---|---|---|
| 4,241,532 | 9/1981 | Robinson | 123/198 D |
| 4,334,406 | 6/1982 | Todd | 123/198 D |
| 4,373,850 | 2/1983 | Durham | 123/386 |
| 4,729,357 | 3/1988 | Freudenschuss et al. | 123/198 D |
| 4,750,463 | 6/1988 | Peter et al. | 123/479 |
| 4,773,370 | 9/1988 | Koshizawa et al. | 123/359 |
| 4,893,599 | 1/1990 | Melnik et al. | 123/359 |
| 4,911,121 | 3/1990 | Barnes | 123/385 |
| 5,052,507 | 10/1991 | Luft et al. | 123/401 |

FOREIGN PATENT DOCUMENTS

| | | |
|---|---|---|
| 100450 | 2/1984 | European Pat. Off. . |
| 3601881 | 4/1987 | Fed. Rep. of Germany . |
| 2100343 | 12/1982 | United Kingdom . |
| 2157367 | 10/1985 | United Kingdom . |

OTHER PUBLICATIONS

WO, 8601256, Feb. 27, 1986.

Patent Abstracts of Japan, vol. 7, No. 244 (M-252) (1389, Aug. 1983.

*Primary Examiner*—Willis R. Wolfe
*Assistant Examiner*—Thomas Moulis
*Attorney, Agent, or Firm*—Michael J. Striker

[57] ABSTRACT

In an electrically controlled actuation of a load adjusting element (3) corresponding to the position of an arbitrarily adjustable transmitter member (28) and corresponding to other parameters with the aid of a control device (19) and an electrically controlled adjusting device (16) the problem arises that it is necessary that actuation of the adjusting lever (3) of the fuel injection pump still be possible during failure of the electrical control unit or power supply. This is effected in that the transmitter member (28) and the adjusting device (16) are coupled in each instance via a coupling (23, 32) which can be locked by hydraulic and/or pneumatic adjusting means, one of which is locked and the other unlocked depending on the operating situation.

9 Claims, 1 Drawing Sheet

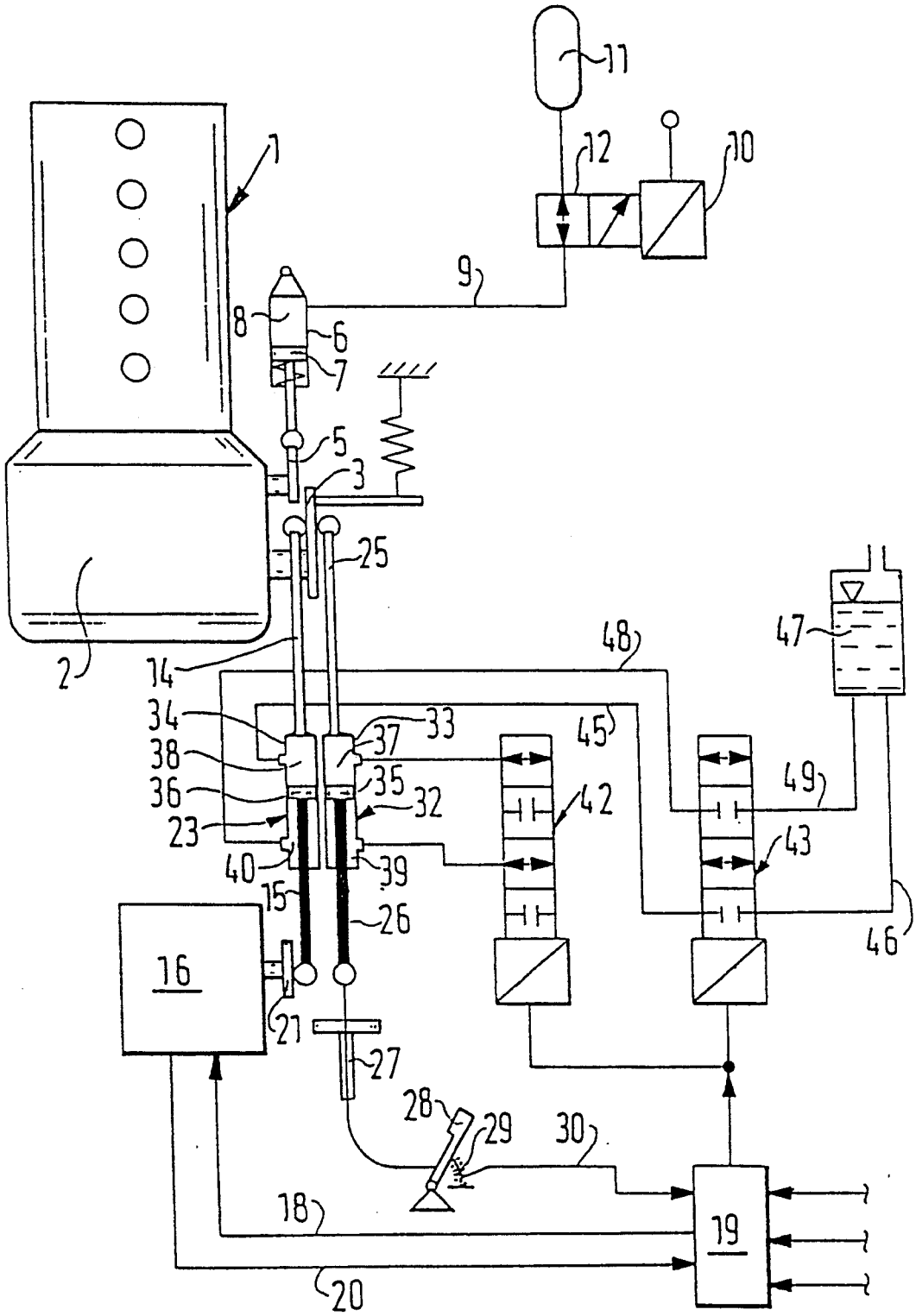
11
12
10
1
9
8
6
7
5
3
25
2
14
48
47
34
33
37
45
38
35
49
36
32
42
23
43
40
39
15
26
46
16
21
27
28
29
30
18
19
20

DEVICE FOR ACTUATING A LOAD ADJUSTING ELEMENT OF A FUEL SUPPLY DEVICE FOR INTERNAL COMBUSTION ENGINES

BACKGROUND OF THE INVENTION

The invention relates to a device for actuating a load adjusting element of a fuel supply device for internal combustion engines. In such a device the position of the transmitter member is transmitted via a transmitter to the electrical control device which transforms this transmitter signal into an adjusting signal while taking into account other possible parameters to be accounted for and passes it on to an adjusting device, e.g. an electric motor. The output of the adjusting device is connected with an adjusting lever of a fuel injection pump via a rod linkage, which adjusting lever varies the fuel injection quantity or the power delivered by the internal combustion engine. This adjusting lever can also be designated as a load adjusting element, its position determining the quantity of fuel injected at the instantaneous speed of the internal combustion engine depending on the construction of the regulating device assigned to the fuel injection pump. A coupling is located inside the rod linkage and can interrupt the connection between the adjusting device and load adjusting element at a signal from the control device. The position of the output of the adjusting device is reported back to the control device and the load adjusting element is thus reset to the reference value predetermined by the control device in normal operation. If a permanent error signal occurs the device is in a defective operating situation. For such cases the known device has a mechanical coupling between the transmitter member and the load adjusting element in the form of a rod linkage and a lever which can be coupled with the load adjusting element via a spring with the intermediary of an idle path in the adjusting range of the rod linkage. In the event of an error in operation the transmitter member adjusts the load adjusting element via the mechanical coupling. In this first operating situation corresponding to a proper functioning, the idle path of the mechanical rod linkage allows the load adjusting element to be adjusted without being influenced by the latter.

However, this device has the disadvantage that a determined idle path must be predetermined, the adjusting effectiveness of the transmitter member being reduced by this idle path during emergency operation in which the connection between the adjusting device and load adjusting element is interrupted as was mentioned above. In this case, in a given position of the transmitter member, the position of the load adjusting element no longer corresponds to the position in the operating situation characterized by proper functioning. Further, a stirrup spring, which in turn works in opposition to another restoring spring, is used for the transmission so that there is no rigid coupling between the transmitter member and the load adjusting element and a deviation of the load adjusting element adjustment during emergency operation relative to normal operation accordingly also occurs in this instance and can also be varied depending on the adjusting resistance.

SUMMARY OF THE INVENTION

Accordingly, it is an object of the present invention to provide a device for actuating a load adjusting element of a fuel supply device for internal combustion engines, which avoids the disadvantages of the prior art.

In keeping with these objects and with others which will become apparent hereinafter, one feature of the present invention resides, briefly stated, in a device of the above mentioned general type in which a wall which is movable relative to the housing is provided as a second coupling between a transmitter member and a load adjusting element and separates two pressure spaces in the housing which are filled with adjusting media and separated from one another via switching valve in the second operating situation and are connected with one another directly or via an adjusting medium supply in the first operating situation; another wall is provided as a first coupling between the adjusting device and the load adjusting element and is movable relative to a housing and separates two pressure spaces in the housing which are filled with adjusting medium and are connected with one another via a switching valve directly or via an adjusting medium supply in the second operating situation and are separated from one another in the first operating situation.

When the device for actuating a load adjusting element is designed in accordance with the present invention, it has the advantage that it ensures a smooth transition between an actuation of the load adjusting element in the first operating situation corresponding to a properly functioning device and an actuation in the second operating situation corresponding to a defective functioning of the control device or in emergency operation. The movable wall in one coupling can be locked in every position while simultaneously canceling the locking of the movable wall of the other coupling. This also results in advantageous adjusting possibilities for bringing the two types of actuation of the load adjusting element on a par via the coupling.

It is particularly advantageous, according to a further embodiment, if a hydraulic adjusting medium is used as adjusting medium in the first coupling and air is used as adjusting medium in the second coupling. This has the advantage that the adjustment of the load adjusting element is impeded as little as possible by the movable wall which is adjusted as a result of the adjustment of the load adjusting element when controlling differences between the reference value and actual value by means of the adjusting device. The air which is taken from the atmosphere ensures that the volumes in the housing which are changed by the adjustable wall are compensated for virtually without resistance. On the other hand, the wall in the first coupling is locked in the first operating situation in a very favorable manner and with little flexibility.

According to another embodiment an adjusting diaphragm is advantageously used as a movable wall. The adjusting diaphragm can be tightly clamped in the housing in a very simple manner so that leakage losses are ruled out. Finally, the construction according to still a further embodiment provides the advantage that a mechanical emergency actuation of the load adjusting element by the transmitter member is possible during a failure of the mains in every case, since the switching valves lock the pressure spaces of the second coupling and open the pressure spaces of the first coupling relative to one another during a power outage.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view schematically showing a device for actuating the load adjusting element of a fuel supply device for internal combustion engines.

DESCRIPTION OF A PREFERRED EMBODIMENT

A fuel injection pump 1 by means of which an internal combustion engine, not shown in more detail, of a motor vehicle is supplied with fuel is shown schematically in the drawing. This can be a series injection pump or fuel injection pump of another type, e.g. a distributor injection pump. This fuel injection pump has an adjusting lever 3 in the area of its regulating device 2, which adjusting lever 3 controls the amount of fuel to be injected per cylinder of the internal combustion engine, e.g. by adjusting a regulator spring of the regulating device 2, or controls the fuel quantity in operating points in which the mechanical regulating device in not active by direct adjustment of the fuel metering part internal to the injection pump. The adjusting lever is an output adjusting element or load adjusting element which controls the fuel injection quantity necessary for overcoming the load occurring at the internal combustion engine or the output of the internal combustion engine.

The fuel injection pump also has a shut-off lever 5 which is connected with a pneumatically working work cylinder 6. The latter has a piston 7 which is adjustable against spring force by compressed air introduced into its work space 8 and actuates the shut-off lever. The work space is connected with a compressed air store 11 or the surrounding air 12 via a pressure line 9 and a 3-way valve 10.

Depending on the control system, the shut-off lever can be actuated by introducing compressed air either in the operating direction or in the shut-off direction.

For actuating the adjusting lever 3, the latter is connected with an adjusting device 16 via a transmission device, e.g. a rod linkage 14 and 15. The adjusting device is constructed e.g. as an electrical adjusting motor which is controlled and operated by an electrical control device 19 via a control line 18. The respective position of the adjusting lever or a drive crank 21 of the adjusting device is detected as actual position by the control device via a control line 20. The drive crank is connected with the rod linkage 15 which can be coupled with the rod linkage 14 via a first coupling 23.

In addition to the rod linkage 14, 15, the adjusting lever is connected by a second rod linkage 25, 26 and a Bowden cable 27 adjoining the rod linkage 26 with a transmitter member 28 which can be actuated arbitrarily and is generally the accelerator pedal of a motor vehicle. A position transmitter 29, which guides a load demand inputted via the transmitter member to the electrical control device 19 via a control line 30, is assigned to this transmitter member. The control device has formed a reference value for the adjustment of the drive crank 21 from this load demand in connection with further parameters which can be fed in. The drive crank 21 is actuated by the adjusting device until reaching this reference value which is reported back via the control line 20. A second coupling 32 is arranged in the connection between the rod linkage parts 25 and 26 of the second rod linkage. In the present case, the first and second couplings have a cylinder 33, 34 which is closed on both sides and in which a piston 35, 36, as movable wall, can be displaced in a tight manner. The piston sits at the end of a piston rod which is guided out of the cylinder in a tight manner and forms the second part 15 and 26 of the rod linkage connected with the adjusting device 16 and transmitter member 28. The cylinders 33, 34 are connected in turn with the rod linkage parts 14, 25 leading to the adjusting lever. The pistons 35 and 36 enclose a first pressure space 37 and 38 in the cylinders 33 and 34, respectively, on one side and a second pressure space 39 and 40, respectively, on the other side. The first pressure space 37 and the second pressure space 39 of the cylinder 33 of the second coupling 32 lead to a 4/2-magnet valve 42. The first pressure space 38 and the second pressure space 40 of the cylinder 34 of the first coupling 23 lead to a second 4/2-magnet valve 43. The first pressure space 37 and the second pressure space 39 connect with the atmosphere in the shown starting position of the 4/2-magnet valve 42 so that the piston 35 can be displaced without noticeable resistance inside the cylinder 33 which is connected with the part 25 of the second rod linkage on the adjusting lever side. The pressure spaces are closed externally in the other switching position, not shown, of the magnet valve 42 so that the piston 35 is fixed in its position occupied in the cylinder 33 and the adjusting lever can accordingly be adjusted when the transmitter member 28 is actuated via the Bowden cable 27 and the rod linkage parts 26 and 25 of the second rod linkage. In this operating situation which diverges from normal operation, the piston 36 is freely movable inside the cylinder 34 of the first coupling 23. For this purpose, the magnet valve 43 is simultaneously in a switching position in which the change in volume of the pressure spaces 38 and 40 during an adjustment of the cylinder 34 can be compensated for via the rod linkage 14 and the adjusting lever 3. In this case the first pressure space 38 is connected via a pressure line 45 with the magnet valve 43 and, via the latter and a pressure line 46, with an adjusting medium reservoir 47. The second pressure space 40 in turn is likewise connected, via a pressure line 48, the magnet valve 43 and a pressure line 49 leading from the latter, with the adjusting medium reservoir 47 by means of which the volume forced from the piston 36 of the first coupling 23 can be compensated for in the position of the magnet valve 43 not shown in the drawing.

In a first operating state, the injection quantity control is effected by actuating the adjusting lever via the aforementioned device designated as E-gas in that the control device 19 adjusts the adjusting device 16 corresponding to the position signal of the transmitter member 28 in such a way that the adjusting lever 21 occupies the desired position. In this case the coupling 23 is locked, i.e. the connection between the first pressure space 38 and the second pressure space 40 is interrupted with the aid of the magnet valve 43 as shown in the drawing. In order that an adjustment of the load adjusting element 3 by the adjusting device 16 can be effected by means of a transmission by the rod linkage 14 independently of the second rod linkage 25 when there are differences between the reference and actual values to be compensated for by regulating techniques, the connection between the first pressure space 37 and the second pressure space 39 of the second coupling 32 can be produced simultaneously, which in turn enables the shown position of the magnet valve 42. The compensation of the volume is effected toward the atmosphere.

When a function disturbance is detected by the control device 19, the disturbance being detectable e.g. in that the actual position of the adjusting device 16 can not be brought to the reference position within predetermined tolerance limits, the control device 19 switches the magnet valves 42 and 43, causes the second coupling 32 to lock and simultaneously opens the first coupling 23. The accelerator pedal or transmitter member 28 takes over the currently applicable position of the adjusting lever 3 in that the piston 35 is locked in the position of the cylinder 33 reset by the adjusting lever 3. A further actuation of the adjusting lever and accordingly an adjustment of the fuel injection quantity can accordingly be effected in a continuous manner with the aid of the transmitter member 28 without taking into account other parameters.

Instead of the shown version in which the pressure spaces can be connected to adjusting medium sources such as the atmosphere and adjusting medium reservoir 47 via the magnet valves 42 and 43, the first pressure space and the second pressure space can also be connected with one another or separated from one another by a connection line in which a 2/2-magnet valve is arranged. However, leakage losses can not be compensated for in this arrangement, especially when using a hydraulic adjusting medium. This is enabled in an advantageous manner with the shown solution. A hydraulic fluid is used as adjusting medium for the first coupling 23 and air is used as adjusting medium for the second coupling 32. This has the advantage that the fuel injection pump is actuated by the adjusting device 16 in the first operating situation, which generally prevails. The piston 36 can be locked in a given position in the cylinder 34 in an optimal manner by the low compressibility of the adjusting medium. Since, on the other hand, the piston 35 is displaced in the cylinder 33 by adjusting movements of the adjusting device 16 effected by regulating techniques and volume is displaced, it is advantageous in this case to use air as adjusting medium which opposes this adjusting movement with the least resistance.

The control of the magnet valves 42 and 43 is advantageously selected in such a way that when excited they adjust the position which is shown so that the transmitter member 28 is coupled with the adjusting lever 3 via the second coupling 32 and the first coupling is disengaged when an error occurs and also when the current supply fails via the control device in this second operating situation. A reliable emergency actuation of the adjusting lever is accordingly possible in the second operating situation.

Instead of the shown cylinder with a piston which is displaceable therein, an adjusting diaphragm which is connected with the rod linkage parts 15 and 16 and tightly clamped in a housing of a corresponding type can also be used as a movable wall. In this case there are only very low adjusting medium losses which only occur where the rod linkage 15 and 26, respectively, exits from the housing, which outlet is to be kept very tight. Because of the locking of the movable walls in optional positions, the described device can be adjusted in an extremely simple manner and a smooth transition of the adjusting lever from actuation by E-gas to direct mechanical actuation corresponding to accelerator adjustment is possible.

It will be understood that each of the elements described above, or two or more together, may also find a useful application in other types of constructions differing from the types described above.

While the invention has been illustrated and described as embodied in a device for actuating a load adjusting element of a fuel supply device for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A device for actuating a load adjusting element of a fuel supply device for internal combustion engines particularly for motor vehicles, the device comprising a transmitting member which can be actuated arbitrarily for adjusting a desired position of a load adjusting element; an electrical control device; an adjusting device; a first and a second coupling, said adjusting device being controllable by said electrical control device and connectable with the load adjusting element as a function of the position of said transmitter member via said first coupling while said second coupling can connect the load adjusting element with said transmitter member, said adjusting device being coupled with the load adjusting element via said first coupling and a connection of said transmitter member with the load adjusting element via said second coupling being ineffective in a first operating situation corresponding to proper functioning of said adjusting device controlled by said electrical control device, and in a second operating situation during the defective functioning of said control device and said electrical adjusting device a connection of said adjusting device with the load adjusting element via said first coupling being interrupted and connection of said transmitter member with the load adjusting element via said second coupling is effective; a housing having two pressure spaces which are filled with adjusting media, a second wall which is movable relative to said housing and provided at said second coupling between said transmitter member and the load adjusting element and separates said two pressure spaces formed in said housing and filled with adjusting media and separated from one another in the second operating situation and connected with one another in the first operating situation, and a first wall provided as said first coupling between said adjusting device and the load adjusting element and movable relative to said housing and also separating said two pressure spaces in said housing which is filled with the adjusting medium and are connected with one another in said second operating situation and separated from one another in said first operating situation.

2. A device as defined in claim 1; and further comprising a switching valve which respectively separates and connects said pressure spaces with one another.

3. A device as defined in claim 1, wherein said adjusting medium in said pressure spaces is a hydraulic adjusting medium.

4. A device as defined in claim 1, wherein said adjusting medium of said second coupling is air, while said adjusting medium of said first coupling is a hydraulic adjusting medium.

5. A device as defined in claim 1, wherein each of said housings is formed as a closed cylinder, each of said walls being formed as a piston which is tightly guided in a respective one of said cylinders.

6. A device as defined in claim 1, wherein each of said movable walls is an adjusting diaphragm which is clamped in said housing.

7. A device as defined in claim 2, wherein said switching valve is a 4/2-way switching valve.

8. A device as defined in claim 1, wherein said switching valve is a magnet switching valve which is bringable into its switching position against a spring force by said control device in the first operating situation.

9. A device as defined in claim 1; and further comprising a shut-off device with a pneumatically working shut-off cylinder.

* * * * *